United States Patent [19]

Berdat

[11] Patent Number: 4,654,562

[45] Date of Patent: Mar. 31, 1987

[54] FLASHING LAMP UNIT

[75] Inventor: Henry F. Berdat, Manchester, Conn.

[73] Assignee: The Gerber Scientific Instrument Co., South Windsor, Conn.

[21] Appl. No.: 684,491

[22] Filed: Dec. 21, 1984

[51] Int. Cl.[4] ..... H05B 37/00; H05B 39/00; H05B 41/14

[52] U.S. Cl. ..... 315/200 A; 362/216; 339/50 C; 315/DIG. 1; 315/DIG. 5; 315/306

[58] Field of Search ..... 315/200 A, 200 R, DIG. 1, 315/DIG. 2, DIG. 4, 307, 306, 310, 311; 362/216; 339/50 C

[56] References Cited

U.S. PATENT DOCUMENTS

| | | | |
|---|---|---|---|
| 3,611,024 | 10/1971 | Nakatsu et al. | 315/DIG. 1 |
| 4,282,563 | 8/1981 | Ohta et al. | 362/216 |
| 4,350,929 | 9/1982 | Katoogi | 315/DIG. 1 |
| 4,358,701 | 11/1982 | Roche et al. | 315/DIG. 1 |
| 4,359,669 | 11/1982 | Anderson | 315/200 A |
| 4,383,202 | 5/1983 | Beck et al. | 315/200 A |
| 4,422,010 | 12/1983 | Hammer | 362/216 |
| 4,437,043 | 3/1984 | Pitel | 315/308 |

*Primary Examiner*—Saxfield Chatmon
*Attorney, Agent, or Firm*—McCormick, Paulding & Huber

[57] ABSTRACT

A flashing lamp unit comprising a fluorescent lamp, an ionization electrode in close proximity to the lamp, and an electrical means for exciting the lamp and ionization electrode to cause the lamp to flash. In one embodiment, the lamp is torroidal in shape, the ionization electrode is arc-shaped and abuts the lamp, and an optical scanning device peers through the center space of the lamp so that the lamp provides a substantially uniform illuminated field for viewing by the scanning device.

6 Claims, 7 Drawing Figures

FLASHING LAMP UNIT

BACKGROUND OF THE INVENTION

The invention relates to flashing lamps and deals more particularly with a fluorescent lamp and associated electronic unit which causes the lamp to periodically flash. The flashing lamp may be used to illuminate a target which is being viewed by a video camera in a system where the camera and target are moving relative to one another, such as, for example, in a line follower system.

Previously, Xenon lamps have been used as a source of flashing light and within such lamps are gas and two spaced apart electrodes. To illuminate a Xenon lamp, a large voltage of the order of several kilovolts is applied between the electrodes and this voltage causes a current to arc across the gas between the electrodes, and this arc directly provides a source of light. Xenon lamps are available in spherical and linear shapes and possibly others. In a typical spherical lamp, the electrodes are spaced apart by less than an inch. Consequently, the light produced by an arc from such a spherical Xenon lamp is highly concentrated and will likely cause uneven illumination of a target. This problem is serious in a typical line follower system in which an optical scanning device, light source, and associated mechanical parts are located very close to one another and to a source of graphic material because such a close arrangement leads to a significant amount of reflections and shadows. Also, a light source which provides symmetrical illumination is especially important when the target is three-dimensional because such targets are inherently prone to shadowing. It is possible to use a defocusing lens in front of such a Xenon lamp to disperse the light more uniformly over the target area. However, for certain video applications the illumination field still contains illumination variations.

Linear or "pencil" lamps of the Xenon variety are available with electrodes spaced apart by three-four inches, and by virtue of the increased spacing and resultant arc length, such lamps provide a more dispersed source of light and a more uniform illumination of a large target than possible with the spherical variety described above.

To improve the uniformity of illumination it is helpful if the source of light is symmetrical relative to the target area and a viewing axis or line of sight of an optical scanning device, and with a single, spherically shaped lamp of any variety it is difficult to provide such symmetry because to do so may require that the scanning device be located in front of the lamp and this arrangement would block much of the light to a target area near the front of the optical scanning device.

To provide a more symmetrical source of illumination than that provided by a single, spherically shaped Xenon lamp, a plurality of such Xenon lamps can be utilized, evenly spaced around a viewing axis of an optical scanning device, the more lamps the more uniform the resultant illumination. However, the additional lamps increase the cost of the light source, requirements for power, and production of heat.

As an alternate source of relatively uniform illumination, two linear Xenon lamps, such as described above, may be arranged parallel to one another with an optical device situated such that its viewing axis passes between the pencil lamps.

In a system in which a target is being viewed by a video camera and the target and video camera are moving relative to one another, a stroboscopic light source may be used to "freeze" an image of the target so that the camera can generate a series of acceptably clear pictures. To periodically flash one or more Xenon lamps of the spherical or linear variety in such a stroboscopic manner, a short burst of electrical energy may be applied to the lamp periodically as, for example, by periodically applying a pulse of voltage between the associated electrodes. An ionization electrode used in conjunction with a linear Xenon lamp may be located along the shell of the lamp near the gap between the other two electrodes within the lamp and electrically shorted to one electrode within the lamp, and such an additional electrode used in conjunction with a spherical Xenon lamp may be located within the lamp in the gap between the other two associated electrodes. When an excitation voltage is applied between the two electrodes, whin either variety of Xenon lamp, and to the extra electrode, the extra electrode aides in ionizing the gas within the lamp.

Shorter flashes of light, less than five hundred microseconds each, may preferred in the video "frame-grabbing" or stroboscopic application described above.

Flourescent bulbs on the other hand are typically used as a more continuous source of light such as for room lighting or desk lighting purposes. A flourescent lamp ordinarily comprises a glass tube, two filaments serving as two cathodes or a cathode and an anode, one filament at each end of the tube, a coating of powdered phosphor on the inside of the tube, and argon gas and a small amount of mercury within the tube. To illuminate the lamp, an operator usually closes a switch which causes the cathode to be heated by an electrical current to provide a source of free electrons. Then, by means of a starter coil and choke, a large voltage is applied between the anode and the cathode which causes the argon gas to ionize and soon afterwards causes the mercury to conduct between the two filaments. As the mercury conducts, it radiates ultraviolet light which is absorbed by the phosphor on the inner surface of the tube and in response, the phosphor re-radiates light in the visible spectral range to provide illumination.

Using an ordinary fluorescent lamp excited in the manner above, it is abnormal to switch the lamp on and off very frequently because the relatively high voltage and current needed to begin the conduction and illumination process has an adverse impact on a coating on the filament. See *Science and Invention Encyclopedia*, H.S. Stuttman Co., Inc. Publisher, New York, Vol. 6, Page 768. Also, such an excitation system even if switched on and off automatically cannot cause a fluorescent lamp to flash for very short durations such as required in some video frame-grabbing or other stroboscopic applications.

Accordingly a general aim of the invention is to provide a substantially uniform and periodic source of flashing light for an optical scanning device.

Another aim of the invention is to utilize a fluorescent lamp as a source of flashing light.

A more specific aim of the invention is to provide a substantially uniform light source which is periodically flashed for a duration of less than one millisecond and preferably shorter.

Still another aim of the invention is to provide a flashing lamp unit which provides the illumination uniformity and short flash duration described above yet has acceptable cost, heat dissipation, and ultraviolet light radiation characteristics.

Yet another aim of the invention is to provide a flashing lamp unit comprising a fluorescent lamp which is housed in such a way that it easily can be replaced after it burns out.

SUMMARY OF THE INVENTION

The present invention resides in a fluorescent lamp, means for periodically delivering current to the lamp, and an ionization electrode used for facilitating the conduction of the lamp in response to said current. According to one feature of the invention, the ionization electrode receives a voltage approximately the same time that voltage is applied between the anode and cathode, and the cathode is heated to provide a source of electrons.

In accordance with another feature of the invention, the fluorescent lamp is substantially torroidal in shape and can be used in conjunction with an optical scanning device which peers through the center space of the lamp so that the lamp provides substantially uniform illumination for a target viewed by the optical scanning device.

In a flashing lamp unit embodying the present invention a fluorescent lamp is supported in close proximity to a ionization electrode yet the fluorescent lamp is easily replaceable.

DETAILED DESCRIPTION OF THE PREFERRED EMBODIMENT

Figure 1:
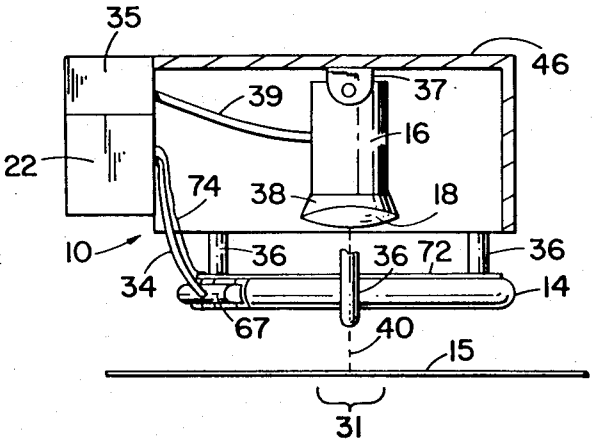
FIG. 1 is a schematic view of a flashing lamp unit embodying the present invention.

Turning now to the drawings, FIG. 1 schematically shows a flashing lamp unit generally designated 10 embodying the present invention and includes a torroidal shaped fluorescent lamp 14, an ionization electrode 72 in close proximity to the fluorescent lamp, and an electronic control unit 22 which activates the lamp in a flashing mode. The lamp in the illustrated embodiment is supported in a generally horizontal plane beneath a video camera 16 which is one type of optical scanning device which may be used in conjunction with the flashing lamp unit 10, and the video camera 16 peers downwardly along a viewing axis 40 through the center space of the fluorescent lamp onto a target region 31 which in the illustrations of FIGS. 1 and 2 is part of a sheet 15 having a line 42 inscribed thereon.

The lamp 14 is supported beneath a housing 46 by clamps 36, 36 and is electrically connected to the electronic control unit 22 by means of a cable 34 which terminates with a female plug 67. The camera 16 is supported within the housing 46 by a bracket 37 and communicates with a digital processing unit 35 by means of a cable 39, and within the camera is a focusing lens 18.

Figure 2:
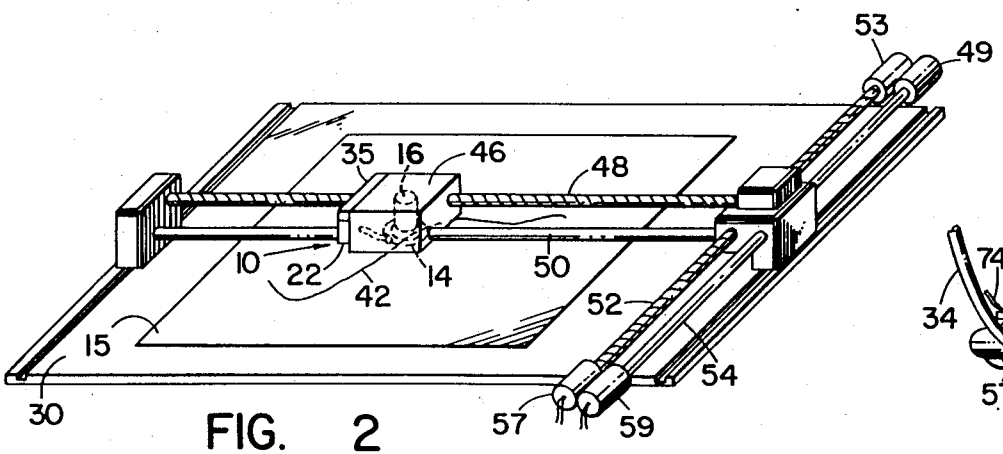
FIG. 2 is a perspective view of a line follower apparatus which includes the flashing lamp unit of FIG. 1, a table and a sheet of graphic material mounted thereon, and an apparatus for moving the flashing lamp unit in a horizontal plane relative to the sheet.

The flashing lamp unit 10 has multiple uses, one of which is in a line follower system such as shown perspectively in FIG. 2. There, the flashing lamp unit is supported over a table 30 for movement in a plane generally parallel thereto. As illustrated in FIG. 2, the camera 16 is scanning a portion of the curved line 42 and is in the process of "following" the line 42. In the line following process, the camera 16 and the flashing lamp unit 10 as well as the digital processing unit 35 and housing 46 move along the line, and this movement is made possible in one coordinate direction by means of a lead screw 48, guide bar 50 and an associated drive motor 49 coupled through spline shaft 54 and a gear assembly (not shown); and in another coordinate direction by means of a lead screw 52 and an associated drive motor 53. Sensors 57 and 59 continually indicate the position of the camera 16. The mechanisms for moving the camera 16, flashing lamp unit 10, housing 46, and unit 35 in a plane generally horizontal to a flat surface or sensing their position are not central to the present invention and for a further description, reference may be made to U.S. Pat. No. 3,529,084 to Rich which issued Sept. 15, 1970 and is assigned to the assignee of the present invention and hereby incorporated by reference as part of the present disclosure.

Figure 3:
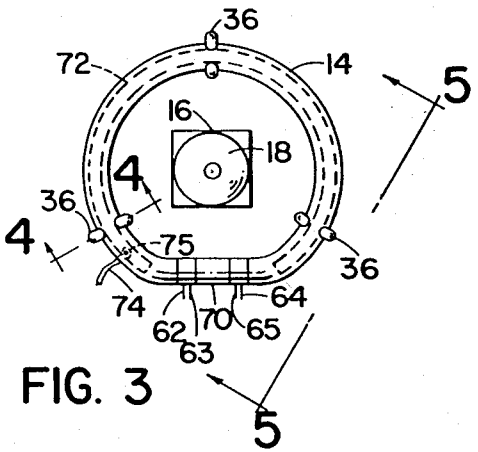
FIG. 3 is an enlarged bottom view of a lamp and an optical scanning device of FIG. 2.

FIG. 3 shows an enlarged bottom view of the lamp 14 and camera 16 of FIG. 2, and in the illustrated embodiment the viewing axis 40 of the camera 16 is coincident with the axis of the torroidal lamp 14. When using the flashing lamp unit 10 to illuminate a target in a line following or other system where the camera and target move relative to one another, it is useful to freeze the image periodically so that individual frames of an image produced by the video camera 16 are not blurred. One way to freeze the image is by use of a source of light which flashes periodically, each flash persisting for a short duration to produce a stroboscopic effect. The use of a stroboscope to perform a frame freezing function is analogous in function to the use of a mechanical shutter which periodically opens for a short period to allow light originating from a continuous source of light and reflected from a target to enter and act on photosensitive elements within a camera.

The electronic contol unit 22 causes the lamp 14 to flash by electrically exciting an anode 56, a cathode 58, (the anode and cathode shown in FIG. 6) and an ionization electrode 72 which in the orientation portrayed in FIG. 2 is in close proximity to and actually engages the top of the lamp 14, and is approximately 310 degrees in arc length. The anode 56 comprises a filament located within a cuff 57 at one end of the lamp, and there are two pins 62 and 63 which connect to the ends of the anode 56 and protrude out from the cuff. Cathode 58 also comprises a filament which is located within a cuff 59 at the other end of the fluorescent lamp 14 and there are two pins 64 and 65 which connect to the ends of the filament and protrude out from the cuff 59. A plastic insulator 70 separates the two ends of the lamp 14 and, for purposes of this specification, the lamp 14 would still be considered torroidal even if the plastic insulator 70 was removed leaving a gap.

Figure 4:
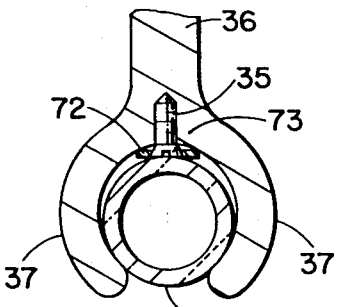
FIG. 4 is an enlarged inverted cross-sectional view of the lamp of FIG. 3 taken on the line 4—4.

The lamp 14 is supported by pliable, snap-fit clamps 36, 36 into which the lamp is forced and maintained by friction and receiving ends 37, 37 which partially enclose the lamp. As shown in FIG. 4, which is an enlarged cross sectional view, the ionization electrode 72 is permanently secured to a bifurcation region 73 of each clamp 36 by a countersunk screw 35 which is driven into clamp 36. Since the clamps 36, 36 are themselves attached to the housing 46 which may be constructed of metal and grounded, the clamps 36, 36 are made of an insulating material such as plastic, and the screws 35, 35 of the preferred embodiment do not pierce through the clamps 36, 36 so the ionization electrode is insulated from the housing 48. Another way to secure the ionization electrode in place yet insulate it from the housing 46 is to use insulated screws such as those made of nylon, and they may be driven, if desired, all the way through the clamps 36, 36 into the housing 46.

Figure 5:
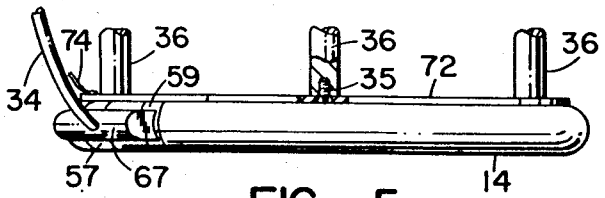
FIG. 5 is an enlarged side sectional view of the lamp, an ionization electrode, support clamp, and a connector taken on the line 5—5 of FIG. 3 wherein the view of one support clamp is sectional.

FIG. 5 is a side view, partially sectioned which shows the ionization electrode 72, a wire 74 and an eyelet 75 which electrically connect the electronic unit 22 to the ionization electrode 72. The pins 62, 63, 64, and 65 shown in FIG. 3 are received by the female plug 67 which fits over them. Because the ionization electrode 72 is permanently attached to the clamps 36, 36 and there is no direct electrical connection between the ionization electrode and the lamp 14 and the lamp is supported in the snap fit clamps 36, 36 and electrically connected to the electronic control unit 22 by means of the plug 67, when the fluorescent lamp 14 burns out, it easily can be replaced.

Figure 7:
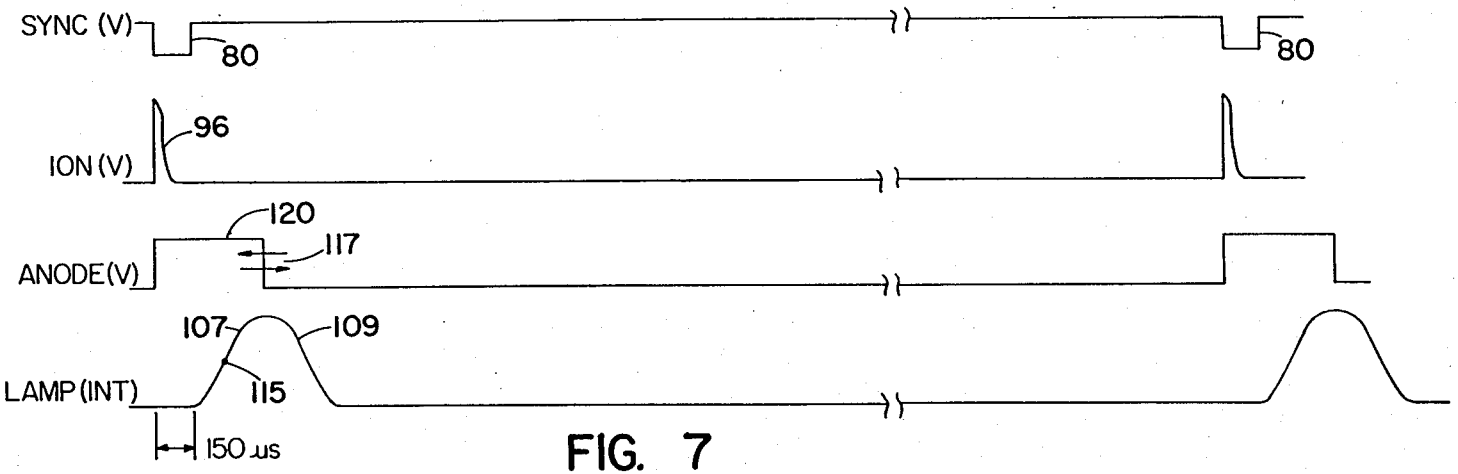
FIG. 7 is a timing diagram for the flashing lamp unit of FIG. 1.
Figure 6:
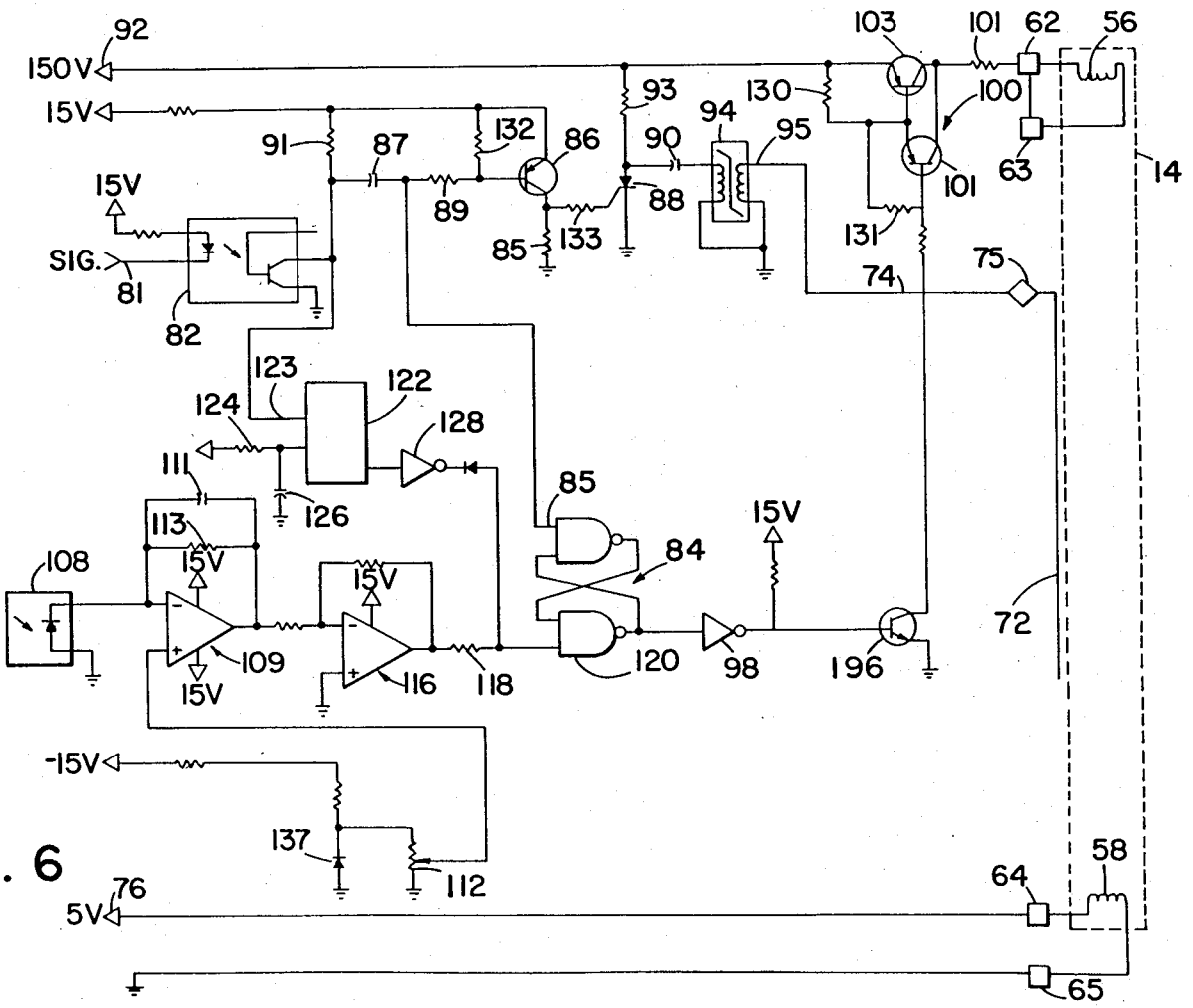
FIG. 6 is a circuit diagram of the flashing lamp unit of FIG. 1.

FIG. 6 shows a circuit diagram of the electronics within electronic control unit 22 which is responsible for causing lamp 14 to flash, and will be described in reference to a timing diagram shown in FIG. 7. The electronics within the digital processing unit 35 will not be described in detail because it is not essential to the present invention except to say that it generates an inverted synchronization pulse 80 every 16.6 milliseconds (60 Hertz) and sends it to an input 81 of optical coupler 82. This pulse causes the optical coupler to conduct and in so doing, draws a current from the base of a PNP transistor 86 via a current limiting resistor 89 and a timing capacitor 87 to activate the transitor, and causes a low level digital signal to be sent to an input 85 of a flip-flop 84 via the timing capacitor 87 to set the flip-flop. Resistor 91 serves as a pull-up resistor for the optical coupler 82. Since the current drawn from the base of PNP transistor 86 and a current associated with the low level digital signal delivered to flip-flop 84 both flow through capacitor 87, they gradually charge the capacitor so that a short time after flip-flop 84 is set and the transistor 86 caused to conduct, the level of voltage applied to the input 85 of flip-flop 84 becomes a digital high level and replaces the previous set signal, and the voltage applied to the base of transistor 86 rises and reverse biases it. This timing function of capacitor 87 could also be accomplished by utilizing a synchronization pulse of appropriately short duration.

While the PNP transistor 86 is activated, it delivers a current to the gate of a silicon controlled rectifier (SCR) 88 which causes the SCR to conduct. A resistor 85 shunts leakage current produced by transistor 86 away from SCR 88 when transistor 86 is supposed to be off and another another resistor 132 shunts other leakage current away from transistor 86 at the same time. A capacitor 90 which had charged to 150 volts through resistor 93 and a primary coil of transformer 94 prior to the conduction of SCR 88, rapidly discharges through SCR 88 when SCR 88 conducts and in so doing, causes a current to be drawn through the primary of the transformer 94. Transformer 94 has a 40-1 voltage transfer characteristic and so develops a 6,000 volt spike, typically less than 100 microseconds in duration, across its secondary coil. One end of the secondary is grounded and the other end 95 is shorted by the wire 74 to the ionization electrode 72 to apply a 6,000 volt spike to the electrode 72 relative to the ground of the secondary. The ionization electrode 72 acts as an antenna which transmits an electromagnetic wave corresponding to its excitation voltage and this electromagnetic wave causes the gas inside the fluorescent lamp 14 to ionize. This ionization step facilitates the conduction of the fluorescent lamp by allowing a current to flow between anode 56 and cathode 58 of the lamp in a very short period of time and so permits the production of a short flash of light. The timing diagram of FIG. 7 shows a voltage spike 96 which represents the voltage, relative to ground which is applied to the ionization electrode 72.

For all practical purposes, the creation of the voltage spike at the ionization electrode 72 occurs simultaneous with the setting of the flip-flop 84 and a sequence of events within the flashing lamp unit 10 triggered by the setting of the flip-flop. When flip-flop 84 sets, it activates an NPN transistor 196 via an inverting open collector buffer 98 and in response, transistor 196 conducts and activates PNP transistors 101 and 103 arranged as a Darlington pair 100. Consequently, the Darlington pair 100 applies a voltage from the 150 volt supply 92 to the anode 56 via a two ohm current limiting resistor 101 and after approximately 150 microseconds, this voltage causes a large current of the order of 10 amperes to flow from the power supply, through the Darlington pair 100, through the resistor 101, and from the anode 56 to the cathode 58 of the lamp 14. Cathode 58 is continually heated by a 5 volt power supply 76 to provide a source of free electrons which are involved in the conduction of the lamp 14 described above. In the illustrated embodiment, the voltage is applied to both ends of the anode 56 through pins 62 and 63, the double connection to the anode made as a precaution so that if one connection were to accidentally break, the anode would still receive an operating voltage.

The current which conducts from the anode 56 to the cathode 58 causes the gas in the lamp to radiate ultraviolet light and this ultraviolet light is absorbed by the phosphor coating on the shell of the lamp. Consequently, the phosphor re-radiates light in the visible spectral range. The intensity of the light produced by the lamp does not achieve a maximum level instantly but, increases rapidly as indicated by an intensity graph 109, nevertheless a photovoltaic cell 108, Sharp Model BS 500A for example, senses the level of light produced by the lamp 14 and produces a power proportional to the intensity of the light. Also, the photovoltaic cell 108 develops a negative voltage proportional in magnitude to the power it produces and applies its negative voltage to the inverting input of a comparator 109. Simultaneously, a potentiometer 112 applies another negative voltage to the noninverting input of comparator 109 at a level between 0 and −0.7 volts, the limits being set by a diode 137. The potentiometer voltage serves as a threshold voltage for the voltage produced by the photovoltacic cell 108 and indirectly as a threshold for the level of light produced by lamp 14. While the light intensity is below the threshold level and for that matter, while the lamp is off during the period before the synchronization pulse arrives, the absolute value of the voltage produced by the photovoltaic cell is less than that produced by the potentiometer 112 and because both voltages are negative and the voltaic cell 108 inputs to the inverting input of the comparator 109, the comparator outputs a large negative voltage. This voltage is applied to the inverting input of an amplifier 116 which is operated between positive 15 volts and ground and, in response to the large negative voltage applied by comparator 109, delivers a correspondingly large positive voltage to a reset input 120 of flip-flop 84. The large positive voltage produced by amplifier 116 corresponds to a high level digital signal and, being high, does not reset flip-flop 84.

Then when the light intensity of lamp 14 increases enough to cause photovoltaic cell 108 to produce a negative voltage larger in absolute value than that of the threshold level set by potentiometer 112, the comparator begins to switch from its previous negative voltage state to a positive voltage state. The transition time between the two states is delayed by a feed back capacitor 111 connected in parallel with a large resistor 113. As a result, if a threshold voltage is set by potentiometer 122, corresponding to a lamp intensity such as intensity 115 shown in FIG. 7, the flip-flop 84 will not be reset as soon as the lamp 14 reaches that threshold intensity. Instead, flip-flop 84 will be reset a short time after the threshold intensity is reached, the precise time dictated by the delay caused by the capacitor 111 and the resistor 113. One reason that the delaying capacitor 111 is utilized is because the intensity of light emitted from lamp 14 rises steeply and relatively linearly for only a short period, typically less than some desired flash durations, and with the delay caused by the feedback capacitor 111, the threshold intensity can be set within the steep linear region which makes it easy to establish a relatively constant flash duration. It was found that a value of 0.002 microfarads for capacitor 111 and a value of 100 kilohms for resistor 113 were suitable in the flashing lamp unit 10.

Once the comparator 109 switches from its negative voltage state to its positive voltage state, the inverting amplifier 116 resets flip-flop 84 which sends a signal to buffer 98 to turn off transistor 196. Consequently, Darlington pair 100 shuts off and the lamp 14 ceases to conduct or illuminate. Resistor 130 and 131 shunt leakage current away from transistors 103 and 101, respectively, to ensure that they shut off when flip-flop 84 is reset. The falling edge of the graph of the anode voltage 120 shown in FIG. 7 indicates the turning off of power to the anode, and the falling edge of the lamp intensity curve demonstrates the resultant shutting off of the lamp 14. As indicated by the arrows 117 which cross the falling edge of graph 120, the duration of the anode voltage pulse is variable (according to the setting of potentiometer 112) and with it the duration of the flash. However, there is a limit as to the minimum duration available from the flashing lamp unit 10.

The schematic shown in FIG. 6 also includes a back-up circuit to insure that the flip-flop 84 resets a predetermined time after the lamp begins to flash. The back-up circuit includes a one-shot 122 whose input 123 is triggered by the output of optical coupler 82 at approximately the same time that the flip-flop 84 is set and 150 volts is applied to the anode of lamp 14. In response to the trigger, the one-shot 122 produces a pulse whose width is determined by the value of an external resistor 124 and the value of an external capacitor 126, and in the illustrated embodiment the pulse width is set at approximately 350 microseconds. This pulse is applied to an inverting buffer 128 which outputs to the reset input 120 of flip-flop 84 and when the pulse times out, the buffer 128 sends a low level digital signal to the reset input 84 and resets the flip-flop if it was not previously reset by amplifier 116.

When the flashing lamp unit 10 is used in conjunction with an optical scanning device such as video camera 16 and the camera and target are moving relative to one another, it is desirable to illuminate the target for just long enough for the photosensitive elements of the camera to sense the image and deliver a corresponding electrical signal to a digital processing unit such as unit 35 because the longer the duration of the flash the more that the resultant image is blurred. By way of example, a suitable flash time for a Hitachi, KP120-U video camera is in the range of 100 to 200 microseconds.

In addition, the camera may be called upon to generate 60 frames per second and if so, the flashing lamp unit will be called upon to generate 60 flashes per second. Naturally, this mode of operating the lamp shortens the life of the lamp from what it would be if the lamp was operated from a continuous alternating current source such as a 115 volt, 60 Hertz power supply. However, it was found by experiment that the flashing lamp unit 10 utilizing an off-the-shelf Norelco FC8T9/CW/RS, 22 watt, 8 inch outer diameter torroidal fluorescent lamp typically survives hundreds of hours of operation of the flashing lamp unit 10. In addition, the average power dissipation of the lamp 14 is low, because the duty cycle of the bulb is short, fluorescent lamps such as lamp 14 by their nature do not emit much ultraviolet light, and the lamp 14 provides substantially uniform illumination because of its large size and torroidal shape.

By the foregoing, a flashing lamp unit has been described in the preferred embodiment of the invention. However, it should be understood that numerous modifications and substitutions may be made without departing from the spirit of the invention. For example, a fluorescent lamp having the shape of a linear tube, an arc of a circle, a sphere, or for that matter, most any other shape, when outfitted with an appropriately shaped ionization electrode, can be activated by electronic unit 22 to provide a source of flashing light. In addition, a plurality of fluorescent lamps of any variety can be operated simultaneously by one electronic unit 22 by providing short circuits between the respective anodes, cathodes, and ionization electrodes of each lamp, however modifications may be required to the electronic unit 22 to increase its power output if the combined load greatly exceeds the load requirements of a typical 8 inch, torroidal fluorescent lamp such as the Norelco one described above. If linear lamps are utilized as a source of flashing light, they can be arranged parallel to one another and an optical scanning device situated to peer between them or if spherical lamps are utlized, they can be arranged evenly around an optical scanning device.

There are still other substitutions and modifications which can be made to the flashing lamp unit without departing from the spirit of the invention. The magnitudes of the voltages applied between the anode and cathode and to the ionization electrode can be varied within limits, and the shape of the ionization electrode can be varied as, for example, by making the ionization electrode more or less than a 310 degree arc of a circle. An ionization electrode may comprise a wire, conductive paint or conductive tape instead of electrode 72, and applied or fastened, as the case may be, to the surface of the lamp 14 or other fluorescent lamp utilized, or may comprise an electrode of the strip, paint, wire or tape variety applied or fastened within the lamp 14.

Also, the flashing lamp unit 10 can be used to strobe targets other than a sheet and used in conjunction with other types of optical scanning devices, and by increasing or decreasing the frequency of the synchronization pulse 80, the flashing lamp unit 10 can be flashed at a rate greater or less than 60 flashes per second.

Accordingly, the invention has been described by way of illustration rather than limitation.

I claim:

1. An apparatus for causing a fluorescent lamp to flash repeatedly during a given period of operation, said fluorescent lamp having two electrodes in the form of an anode and a cathode, said apparatus comprising:

means for heating at least one of said electrodes continuously during said period of operation, means for periodically applying a first pulse of voltage across said anode and cathode, means for facilitating the initiation of the conduction of current from said anode to said cathode upon the application of each of said first voltage pulses, said initiation of conduction facilitating means includinig an ionization electrode supported adjacent to the current conduction path between said anode and said cathode, and means for applying a second voltage pulse to said ionization electrode in unison with the application of each of said first voltage pulses across said anode and cathode, the start of each of said second voltage pulses coninciding timewise substantially exactly with the start of each of said first voltage pulses, said second voltage pulses being greater in magnitude than said first voltage pulses.

2. The apparatus defined in claim 1 wherein each of said first voltage pulses is less than one millisecond in duration.

3. The apparatus defined in claim 1 wherein said fluorescent lamp is substantially torroidal in shape, and further comprising means for supporting a sheet of material having an exposed surface to be illuminated by said lamp, means for moving said lamp in a plane generally parallel to said exposed surface so as to be capable of following a line on said surface, an optical scanning device for detecting a line on said surface, and means for supporting said fluorescent lamp in relation to said optical scanning device such that said optical scanning device peers onto said surface through the center space of said fluorescent lamp.

4. An apparatus as set forth in claim 1 further comprising means for controlling the timing of the end of each of said first voltage pulses, said controlling means including means for sensing the level of light produced by said fluorescent lamp, and means responsive to said sensing means for terminating the current one of said first voltage pulses a predetermined time after said level of light as sensed by said sensing means passes a given threshold value.

5. A method for causing a fluorescent lamp to flash repeatedly during a given period of operation, said fluorescent lamp having a tube and two electrodes in the form of an anode and a cathode, said method comprising the steps of:

providing a fluorescent lamp such as aforesaid, providing an ionization electrode outside of said tube along the current path extending between said anode and cathode, continuously heating at least one of said electrodes during said period of operation, applying a series of first pulses of relatively low voltage across said anode and cathode, and applying a series of second pulses of relatively high voltage to said ionization electrode in unison with the application of said first pulses across said anode and cathode and with the start of each of said second pulses coinciding timewise substantially exactly with the start of each of said first pulses.

6. A method as set forth in claim 5 further comprising the step of sensing the level of light emitted by said lamp, and terminating each of said first pulses a predetermined time after said level of light is sensed to have reached a given threshold value.

* * * * *